US012486738B2

(12) United States Patent
Shelton

(10) Patent No.: US 12,486,738 B2
(45) Date of Patent: Dec. 2, 2025

(54) PERFORATING GUN ASSEMBLY

(71) Applicant: HARRISON JET GUNS II, L.P., Kennedale, TX (US)

(72) Inventor: James F. Shelton, Kennedale, TX (US)

(73) Assignee: HARRISON JET GUNS II, L.P., Kennedale, TX (US)

( * ) Notice: Subject to any disclaimer, the term of this patent is extended or adjusted under 35 U.S.C. 154(b) by 0 days.

(21) Appl. No.: 18/726,504

(22) PCT Filed: Jan. 5, 2023

(86) PCT No.: PCT/US2023/010220
§ 371 (c)(1),
(2) Date: Jul. 3, 2024

(87) PCT Pub. No.: WO2023/133211
PCT Pub. Date: Jul. 13, 2023

(65) Prior Publication Data

US 2025/0084737 A1 Mar. 13, 2025

Related U.S. Application Data

(60) Provisional application No. 63/297,312, filed on Jan. 7, 2022.

(51) Int. Cl.

| | |
|---|---|
| ***E21B 43/117*** | (2006.01) |
| ***E21B 43/116*** | (2006.01) |
| ***E21B 43/1185*** | (2006.01) |

(52) U.S. Cl.
CPC ..... *E21B 43/117* (2013.01); *E21B 43/116* (2013.01); *E21B 43/1185* (2013.01)

(58) Field of Classification Search
CPC ... E21B 43/116; E21B 43/117; E21B 43/1185
See application file for complete search history.

(56) References Cited

U.S. PATENT DOCUMENTS

| | | | | |
|---|---|---|---|---|
| 11,867,032 | B1 * | 1/2024 | Parks | E21B 43/1185 |
| 12,012,829 | B1 * | 6/2024 | Roach | E21B 43/119 |
| 2013/0126237 | A1 | 5/2013 | Burton et al. | |
| 2015/0275643 | A1 | 10/2015 | Holder et al. | |
| 2020/0088011 | A1 | 3/2020 | Eitschberger et al. | |
| 2020/0248535 | A1 | 8/2020 | Goyeneche | |

(Continued)

*Primary Examiner* — Yong-Suk (Philip) Ro
(74) *Attorney, Agent, or Firm* — WARNER NORCROSS + JUDD LLP

(57) ABSTRACT

An improved perforating gun assembly. The perforating gun assembly includes an alternating sequence of perforating guns and tandems. Each perforating gun includes two contact housings, and each contact housing includes an electrical connector plug protruding in an axial direction. The electrical connector plug includes an outwardly bowed middle portion that is resiliently deformable—also referred to as a banana pin connector plug. The banana pin connector plug is received within a socket opening in an electrically conductive pass-through element that is centrally received within the tandem. The pass-through element is surrounded by an insulating sleeve, such that the pass-through element is electrically isolated from an electrically grounded portion of the tandem and transfers a firing signal from a first perforating gun to a second perforating gun.

12 Claims, 1 Drawing Sheet

(56) References Cited

U.S. PATENT DOCUMENTS

| | | | | |
|---|---|---|---|---|
| 2020/0256166 | A1 | 8/2020 | Knight et al. | |
| 2020/0308938 | A1 | 10/2020 | Sullivan et al. | |
| 2021/0396103 | A1 | 12/2021 | MacGillivray et al. | |
| 2022/0186588 | A1* | 6/2022 | Shelton | E21B 43/117 |

* cited by examiner

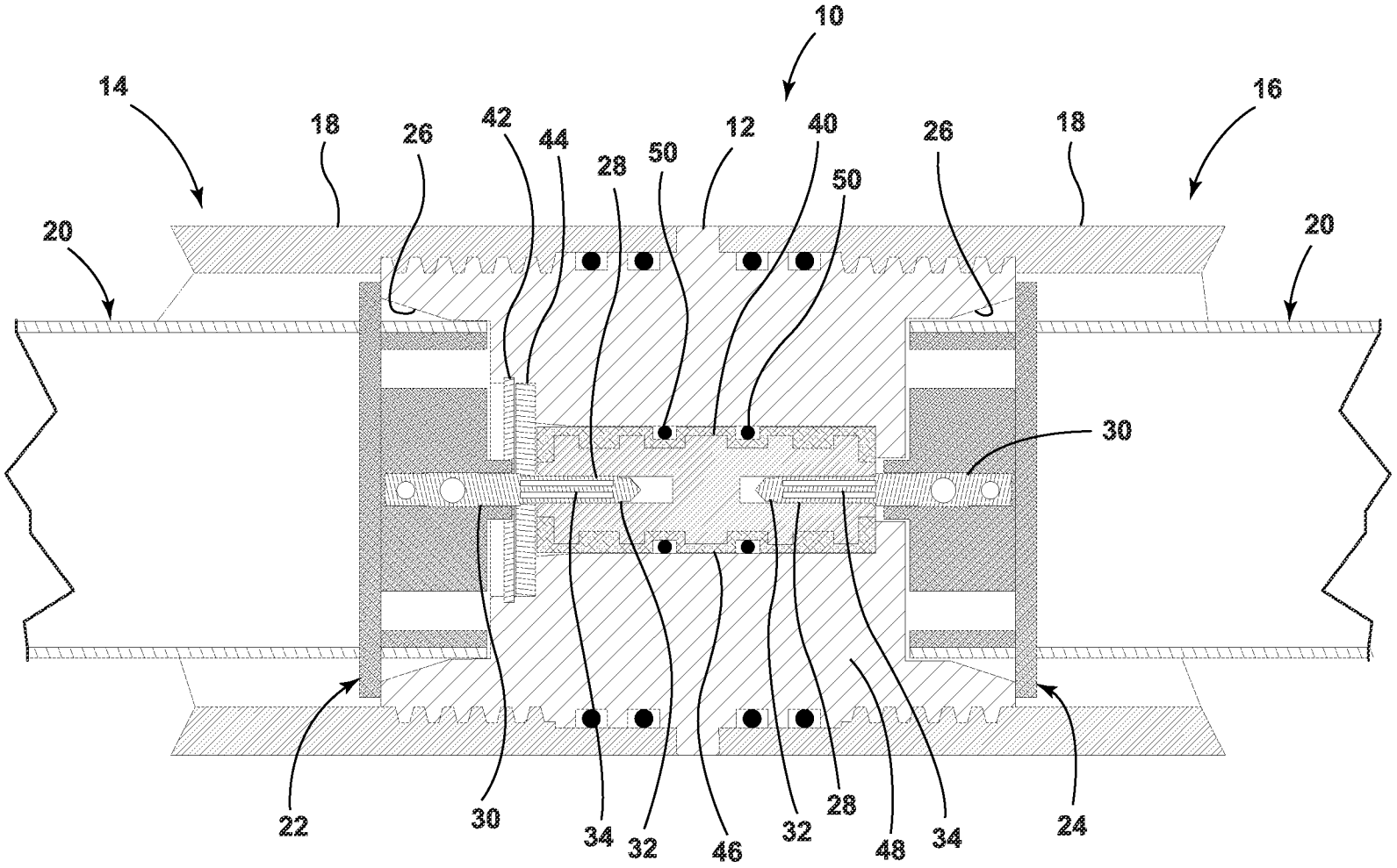
10
12
14
16
18
18
20
20
22
24
26
26
28
28
30
30
32
32
34
34
40
42
44
46
48
50
50

PERFORATING GUN ASSEMBLY

CROSS-REFERENCE TO RELATED APPLICATIONS

This application claims the benefit of U.S. Provisional Application 63/297,312, filed Jan. 7, 2022, the disclosure of which is incorporated by reference in its entirety.

TECHNICAL FIELD

The present invention relates to a perforating gun assembly having penetrating shaped charges to generate entrance holes through a wellbore casing.

BACKGROUND

In oil and gas operations, it is a known practice to install a well casing into a borehole that has been drilled into a geologic formation. A perforating gun assembly is then lowered into the wellbore on a wireline opposite a hydrocarbon formation. The perforating gun assembly includes shaped charges that, when fired, are formed into high-velocity jets that penetrate through the wellbore casing. The resulting perforations create fluid communication with the surrounding geologic formation to allow a fluid (oil or gas) to flow into the wellbore.

A perforating gun assembly will typically include multiple perforating guns, each with opposing box ends having female threads. Adjacent perforating guns are joined to each other via a tandem. Tandems generally include male threads that are threaded to adjacent perforating guns in a gun string. In this fashion, multiple perforating guns can be connected end-to-end and simultaneously detonated within the wellbore. Despite their acceptance, however, there remains a continued need for an improved system for connecting multiple perforating guns in series as a perforating gun assembly or gun string.

SUMMARY OF THE INVENTION

An improved perforating gun assembly including a perforating gun and a tandem is provided. The perforating gun includes two contact housings, and each contact housing includes an electrical connector plug protruding in an axial direction. The electrical connector plug includes an outwardly bowed middle portion that is resiliently deformable—also referred to as a banana pin connector plug. The banana pin connector plug is received within a socket opening in a pass-through element that is centrally received within the tandem. The pass-through element is surrounded by an insulating sleeve, such that the pass-through element transfers a firing signal from a first perforating gun to a second perforating gun while being electrically isolated from an electrically-grounded portion of the tandem.

In one embodiment, the tandem includes a threaded outer body, an insulating sleeve, and a pass-through element. The outer body is electrically grounded and includes a central through-bore interconnecting first and second female openings. The insulating sleeve surrounds the pass-through element, and each of the insulating sleeve and the pass-through element are received within the central through-bore in the threaded outer body. The pass-through element includes a first socket opening at a first axial end thereof and a second socket opening at a second axial end thereof. Each socket opening receives a banana pin connector plug from an adjacent perforating gun. The pass-through element is electrically conductive for transferring a firing signal from a first perforating gun to a second perforating gun.

The pass-through element includes a plurality of exterior corrugations that are aligned with a plurality of annular recesses in the insulating sleeve. The insulating sleeve is secured within the central through-bore of the tandem by interference fit, and a plurality of O-rings are disposed between the insulting sleeve and the outer body of the tandem. The perforating gun assembly can include a snap ring retainer and a retaining washer between a perforating gun and a contact housing, the contact housing being plastic injection molded.

The perforating gun assembly can be assembled on-site by threadably engaging perforating guns and tandems in an alternating sequence. Each tandem includes opposing socket openings for receiving the banana pin connector plug from adjacent perforating guns. For each perforating gun, at least one banana pin connector plug is in electrical communication with an addressable switch. Wires extend from the addressable switch and travel to a detonator in the perforating gun. The perforating gun assembly is then lowered into a wellbore having a wellbore casing, and a firing signal causes shaped charges within the perforating guns to detonate, creating a plurality of perforations through the wellbore casing.

These and other features and advantages of the present invention will become apparent from the following description of the invention, when viewed in accordance with the accompanying drawings and appended claims.

BRIEF DESCRIPTION OF THE DRAWING

FIG. 1 is a cross-sectional view of a perforating gun system in accordance with one embodiment of the present invention.

DETAILED DESCRIPTION

The following detailed description is merely exemplary in nature and is not intended to limit the oilfield perforating systems and methods as described herein. Furthermore, there is no intention to be bound by any theory presented in the preceding background or the following detailed description. The description is not in any way meant to limit the scope of any present or subsequent related claims.

As used here, the terms "above" and "below"; "up" and "down"; "upper" and "lower"; "upwardly" and "downwardly"; and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

Referring now to FIG. 1, a perforating gun system in accordance with one embodiment is illustrated and generally designated 10. The perforating gun system 10 includes a tandem 12 and first and second perforating guns 14, 16. Each perforating gun 14, 16 includes an outer gun barrel 18, an internal shaped charge positioning tube 20, a first contact housing 22, and a second contact housing 24, each being discussed below.

The outer gun barrel 18 includes opposing box ends, and the tandem 12 is threaded a box end of an outer gun barrel 18 so that the perforating guns 14, 16 can be joined in series in a gun string. The outer gun barrel 18 is cylindrical and includes a length that is greater than the length of the shaped charge positioning tube 20, such that the outer gun barrel 18 extends beyond the shaped charge positioning tube 20 as shown in FIG. 1.

The shaped charge positioning tube 20 is generally formed from an electrically conductive material, for example stainless steel. The shaped charge positioning tubes 20 is press-fit into attachment with the tandem 12, the tandem 12 including a sloped sidewall 26 defining a funneled opening. The tandem 12 locks down on the shaped charge positioning tube 20, creating a 360-degree secure ground connection.

The shaped charge positioning tube 20 also includes a cylindrical body having multiple shaped charge openings (not shown) that receive a corresponding number of shaped charges. The openings are angularly offset from each other in some embodiments, but can be in axial alignment in other embodiments. The shaped charge positioning tube 20 includes two shaped charge openings in some embodiment, while other embodiments the internal tube 20 can include greater or fewer number of shaped charge openings.

As noted above, each perforating gun 14, 16 includes a first contact housing 22 and a second contact housing 24. Each contact housing 22, 24 is formed from an electrically insulating material, for example molded plastic. In addition, each contact housing 22, 24 is partially received within opposing ends of the shaped charge positioning tube 20. Each contact housing 22, 24 also includes an electrical connector plug 28 protruding in an axial direction. The electrical connector plug 28 includes a body 30 and a stem 32. The stem 32 is generally configured as a banana pin connector plug and includes an outwardly bowed middle portion 34 that is resiliently deformable. More specifically, the stem 32 includes multiple (e.g., three or four) resiliently deformable arms that bow outward between the tip of the stem 32 and the base of the stem 32. When received within a socket opening, as shown in FIG. 1, the resiliently deformable arms compress radially inward and bear against the socket opening by interference fit, thereby providing a positive mechanical and electrical connection.

As also shown in FIG. 1, the tandem 12 includes a solid anodized pass-through element 40. The pass-through element 40 is secured within a cylindrical opening in the tandem 12 by a snap ring retainer 42 and a steel retaining washer 44. In operation, the firing signal passes through the pass-through element 40 from the electrical connector plug 28 of a first perforating gun 14 to the electrical connector plug 28 of a second perforating gun 16. For each perforating gun 14, 16, at least one electrical connector plug 28 is in electrical communication with an addressable switch (not shown). Wires extend from the addressable switch and travel to a detonator in the corresponding perforating gun 14, 16.

The pass-through element 40 is surrounded by an insulating sleeve 46 that is received within a cylindrical opening in the tandem 12. The insulating sleeve 46 is formed from a non-conductive material to electrically isolate the pass-through element 40 from the tandem body 48, which is electrically grounded. The insulating sleeve 46 includes an inner surface opposite an outer surface. The inner surface is corrugated or ribbed to prevent axial movement of the pass-through element 40. The outer surface includes at least one O-ring 50 to create a seal with the cylindrical opening the tandem 12.

In operation, the firing signal is passed through the tandem 12 from the first perforating gun 14 to the second perforating gun 16. In particular, the firing signal passes from the first electrical connector plug 28, through the pass-through element 40, to the second electrical connector plug 28. The firing signal is also passed to an addressable switch within a contact housing. Wires extend from the addressable switch and travel to a detonator in the perforating gun. The perforating gun assembly is then lowered into a wellbore having a wellbore casing, and a firing signal causes shaped charges within the perforating guns to detonate, creating a plurality of perforations through the wellbore casing.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

The invention claimed is:

1. A perforating gun assembly comprising:

a perforating gun including an outer gun barrel, an internal shaped charge positioning tube, and a contact housing joined to an end portion of the shaped charge positioning tube, the contact housing including an electrical contact element comprising a connector plug having a body and a stem, wherein the connector plug body is received within the contact housing, and wherein the connector plug stem includes a plurality of resiliently deformable arms that bow outwardly and interconnect a base of the connector plug stem to a tip of the connector plug stem; and a tandem that is joined to the perforating gun, the tandem including:

a threaded outer body including first and second female openings, the threaded outer body including a central through-bore interconnecting the first and second female openings, wherein the first and second female openings include a sloped sidewall, an insulating sleeve contained within the central through-bore, the insulating sleeve defining a longitudinal opening therethrough, and a pass-through element within the longitudinal opening of the insulating sleeve, the pass-through element being electrically conductive and including a first socket opening at a first end thereof and a second socket opening at a second end thereof, wherein the electrical contact element of the contact housing is received within one of the first and second socket openings of the pass-through element, such that the plurality of resiliently deformable arms are radially compressed within the first socket opening or the second socket opening by interference fit to provide the connector plug with a positive mechanical and electrical connection to the pass-through element.

2. The perforating gun assembly of claim 1, wherein the first socket opening and the second socket opening extend only partially through the pass-through element, such that the first socket opening and the second socket opening are physically isolated from each other.

3. The perforating gun assembly of claim 1, further including a snap ring retainer and a retaining washer between the contact housing and the tandem.

4. The perforating gun assembly of claim 1, wherein the contact housing is formed from an electrically insulating material.

5. The perforating gun assembly of claim 1, wherein the pass-through element includes a plurality of exterior corrugations aligned with a plurality of annular recesses in the insulating sleeve.

6. The perforating gun assembly of claim 1, wherein the threaded outer body is formed from an electrically conductive material.

7. The perforating gun assembly of claim 1, wherein the insulating sleeve is secured within the central through-bore by interference fit.

8. The perforating gun assembly of claim 1, wherein the central through-bore comprises a counter-bore having a first diameter portion and a second diameter portion, the second diameter portion have a diameter that is less than a diameter of the first diameter portion.

9. The perforating gun assembly of claim 1, further including a plurality of O-rings disposed between the insulting sleeve and the threaded outer body.

10. The perforating gun assembly of claim 1, wherein the pass-through element is electrically isolated from the threaded outer body.

11. The perforating gun assembly of claim 1, wherein the outer body of the tandem is electrically grounded.

12. The perforating gun assembly of claim 1, wherein the threaded outer body includes first and second externally threaded box ends.

* * * * *